US008154567B2

(12) United States Patent
Song et al.

(10) Patent No.: US 8,154,567 B2
(45) Date of Patent: Apr. 10, 2012

(54) LIQUID CRYSTAL PANEL AND LIQUID CRYSTAL DISPLAY DEVICE INCLUDING THE SAME

(75) Inventors: Ki-Sun Song, Cheongju-Si (KR); Jae Bong Choi, Suwon-Si (KR); Hyoung Sik Cho, Seoul (KR); Hyun-Chul Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 798 days.

(21) Appl. No.: 12/150,058

(22) Filed: Apr. 24, 2008

(65) Prior Publication Data

US 2008/0266233 A1 Oct. 30, 2008

(30) Foreign Application Priority Data

Apr. 25, 2007 (KR) ..... 10-2007-0040582

(51) Int. Cl.
*G09G 5/02* (2006.01)

(52) U.S. Cl. ..... 345/694; 345/695; 349/141

(58) Field of Classification Search ..... 345/694–696; 349/141–146

See application file for complete search history.

(56) References Cited

U.S. PATENT DOCUMENTS 6,011,531 A * 1/2000 Mei et al. ..... 345/92
6,320,566 B1 * 11/2001 Go ..... 345/99
6,326,981 B1 * 12/2001 Mori et al. ..... 345/695
6,954,216 B1 * 10/2005 Dowling et al. ..... 345/593
2006/0164350 A1 * 7/2006 Kim et al. ..... 345/87
2007/0058122 A1 * 3/2007 Ong ..... 349/143

FOREIGN PATENT DOCUMENTS

WO WO94/08331 * 4/1994

OTHER PUBLICATIONS

Korean Patent Application No. 1019990015537 to Tatsumi, having Publication date of Aug. 5, 2002 (w/ English Abstract page).

Japanese Patent Application No. 06-194593 to Hiroaki, having Publication date of Feb. 16, 1996 (w/ English Abstract page).

Japanese Patent Application No. 08-230595 to Hiroshi et al., having Publication date of Mar. 17, 1998 (w/ English Abstract page).

Japanese Patent Application No. 10-084423 to Katsumasa, having Publication date of Oct. 15, 1999 (w/ English Abstract page).

* cited by examiner

*Primary Examiner* — Kevin M Nguyen
*Assistant Examiner* — Cory Almeida
(74) *Attorney, Agent, or Firm* — Monica H. Choi

(57) ABSTRACT

A liquid crystal panel includes a first type pixel and a second type pixel that are formed adjacent to each-other. The first type pixel has a first layout of respective first and second sub-pixels, and the second type pixel has a second layout of respective first and second sub-pixels. The first layout is different from the second layout such that the liquid crystal panel is driven according to dot inversion with alternating first and second sub-pixels determining the image displayed on the liquid crystal panel for preventing vertical faults.

17 Claims, 14 Drawing Sheets

FIG. 2 (CONVENTIONAL ART)

| | SY1 | SY2 | SY3 | SY4 | SY5 | SY6 |
|---|---|---|---|---|---|---|
| GY1 | ( + ) | ( − ) | ( − ) | ( + ) | ( + ) | ( − ) |
| GY2 | ( + ) | ( − ) | ( − ) | ( + ) | ( + ) | ( − ) |
| GY3 | ( + ) | ( − ) | ( − ) | ( + ) | ( + ) | ( − ) |
| GY4 | ( + ) | ( − ) | ( − ) | ( + ) | ( + ) | ( − ) |
| GY5 | ( + ) | ( − ) | ( − ) | ( + ) | ( + ) | ( − ) |

FIG. 8

| | SY1 | SY2 | SY3 | SY4 | SY5 | SY6 |
|---|---|---|---|---|---|---|
| GY1 | ( + ) | ( − ) | ( + ) | ( − ) | ( + ) | ( − ) |
| GY2 | ( + ) | ( − ) | ( + ) | ( − ) | ( + ) | ( − ) |
| GY3 | ( + ) | ( − ) | ( + ) | ( − ) | ( + ) | ( − ) |
| GY4 | ( + ) | ( − ) | ( + ) | ( − ) | ( + ) | ( − ) |
| GY5 | ( + ) | ( − ) | ( + ) | ( − ) | ( + ) | ( − ) |

FIG. 12

| | SY1 | SY2 | SY3 | SY4 | SY5 | SY6 |
|---|---|---|---|---|---|---|
| GY1 | ( + ) | ( − ) | ( − ) | ( + ) | ( + ) | ( − ) |
| GY2 | ( + ) | ( − ) | ( − ) | ( + ) | ( + ) | ( − ) |
| GY3 | ( + ) | ( − ) | ( − ) | ( + ) | ( + ) | ( − ) |
| GY4 | ( + ) | ( − ) | ( − ) | ( + ) | ( + ) | ( − ) |
| GY5 | ( + ) | ( − ) | ( − ) | ( + ) | ( + ) | ( − ) |

LIQUID CRYSTAL PANEL AND LIQUID CRYSTAL DISPLAY DEVICE INCLUDING THE SAME

BACKGROUND OF THE INVENTION

This application claims priority under 35 USC §119 to Korean Patent Application No. 2007-0040582, filed on Apr. 25, 2007 in the Korean Intellectual Property Office, the disclosure of which is incorporated herein in its entirety by reference.

1. Field of the Invention

The present invention relates generally to liquid crystal display (LCD) devices, and more particularly to an LCD device having alternating layouts of sub-pixels for reducing vertical faults in the LCD device.

2. Background of the Invention

Generally, a liquid crystal display (LCD) device has a resolution depending on the number of integrated pixels. As the size of the LCD increases, the resolution also increases. For displaying high-quality images, the resolution has been increased with higher integration of pixels in a liquid crystal panel.

For overcoming limitations of liquid crystal response speed, flicker, and lag (or after-image) in high-definition or large-screen LCD devices (e.g., LCD televisions), driving a LCD device at a higher frame rate of 120 Hz instead of a frame rate of 60 Hz has been suggested. However, if 1-dot inversion or 2-dot inversion is used in the LCD device driven at the higher frame rate of 120 Hz, luminance is decreased due to charge deficit, and securing a driving margin is difficult because of gate line delay.

Accordingly, conventional LCD devices use column inversion for securing driving margin despite gate line delay. Therefore, liquid crystal panels using super patterned vertical alignment (S-PVA) with a 1 gate and 2 data (1G2D) structure are driven at a frame rate of 120 Hz with column inversion.

FIG. 1 illustrates a layout of sub-pixels in a conventional liquid crystal panel 10 having super patterned vertical alignment (S-PVA) with a 1G2D structure, in which each pixel is connected to a single gate line and two data lines. Referring to FIG. 1, the liquid crystal panel 10 includes a plurality of gate lines GY1, GY2, and GY3, a plurality of data lines SY1, SY2, SY3, SY4, SY5, and SY6, and a plurality of pixels each including a respective first sub-pixel A and a respective second sub-pixel B.

Each pixel includes a respective first switching element T1 and a respective second switching element T2. The switching elements T1 and T2 are for example NMOSFETs (N-channel metal oxide semiconductor field effect transistors) with each having a respective gate connected to a respective one of the gate lines GY1, GY2, and GY3, and each having a respective drain/source connected to a respective one of the data lines SY1, SY2, SY3, SY4, SY5, and SY6. Each of the switching elements T1 and T2 provides a respective data signal received from such a respective data line to a respective one of the first sub-pixel A and the second sub-pixel B.

The data lines SY1, SY2, SY3, SY4, SY5, and SY6 are paired into adjacent data lines forming a data line pair, e.g., SY1 and SY2, SY3 and SY4, or SY5 and SY6. Each data line pair is connected to the respective two sub-pixels of one pixel for providing respective data signals from a data driver (not shown). For example, one data line SY1 of a data line pair (SY1 and SY2) provides a respective data signal to the first sub-pixel A via the first switching element T1, and the other data line SY2 of such a data line pair provides a respective data signal to the second sub-pixel B via the second switching element T2.

FIG. 2 illustrates voltage polarities of data signals generated from the data driver (not shown) when the liquid crystal panel 10 of FIG. 1 is driven using column inversion. FIG. 3 illustrates voltage polarities as displayed via the sub-pixels A and B on the liquid crystal panel 10 of FIG. 1.

Referring to FIG. 1, a first area of the first sub-pixel A is greater toward a left side of each pixel, and a second area of the second sub-pixel B is greater toward a right side of each pixel in the liquid crystal panel 10. In addition referring to FIGS. 1, 2, and 3, the first data line SY1 that is driven with the positive polarity voltage results in the first sub-pixels A dominating luminance with bias of such positive polarity voltage toward the left side of a first column of pixels. Furthermore, the second data line SY2 that is driven with the negative polarity voltage results in the second sub-pixels B dominating luminance with bias of such negative polarity voltage toward the right side of the first column of pixels.

Additionally, the third data line SY3 that is driven with the negative polarity voltage results in the first sub-pixels A dominating luminance with bias of such negative polarity voltage toward the left side of a second column of pixels. Furthermore, the fourth data line SY4 that is driven with the positive polarity voltage results in the second sub-pixels B dominating luminance with bias of such positive polarity voltage toward the right side of the second column of pixels.

Thus in FIG. 3, each rectangle represents a respective one of the sub-pixels A and B that dominates luminance from having larger area toward each of the left and right sides of a pixel. Thus, two horizontally adjacent rectangles in FIG. 3 represent respective first and second sub-pixels A and B dominating luminance toward the left and right sides of one pixel in FIG. 1.

Such biasing of the sub-pixels of subsequent columns of the liquid crystal panel 10 is repeated to result in FIG. 3 according to column inversion. Referring to FIG. 4, when a common voltage applied to the liquid crystal panel 10 is shifted from Vcom0 to Vcom1, a magnitude of a positive polarity voltage V+ is different from a magnitude of a negative polarity voltage V−, resulting in common voltage asymmetry.

With such common voltage asymmetry, charge accumulation and thus luminance becomes different between the sub-pixels having the positive polarity voltage V+ applied thereon and the sub-pixels having the negative polarity voltage V− applied thereon, especially when the liquid crystal panel 10 is driven at low gradation and low frequency. In addition, when each frame is displayed in a predetermined pattern (e.g., a pattern that is shifted in units of even dots as illustrated in FIG. 5) in the liquid crystal panel 10 driven using column inversion, the border of the pattern maintains the same polarity with induced luminance difference such that a vertical fault occurs.

SUMMARY OF THE INVENTION

A liquid crystal panel according to an aspect of the present invention includes a first type pixel and a second type pixel. The first type pixel has a first layout of respective first and second sub-pixels, and the second type pixel has a second layout of respective first and second sub-pixels. The first layout is different from the second layout.

In an example embodiment of the present invention, the first type pixel is adjacent to the second type pixel with a shared gate line. Alternatively, the first type pixel is adjacent to the second type pixel with a shared data line or with a shared data line pair.

In another embodiment of the present invention, the first layout is rotated 180° from the second layout. The first type pixel includes a respective first area of the respective first sub-pixel that is larger than a respective second area of the respective second sub-pixel toward a first direction in the first type pixel. The respective second area of the respective second sub-pixel is larger than the respective first area of the respective first sub-pixel toward a second direction in the first type pixel. The second type pixel includes a respective first area of the respective first sub-pixel that is larger than a respective second area of the respective second sub-pixel toward the second direction in the second type pixel. The respective second area of the respective second sub-pixel is larger than the respective first area of the respective first sub-pixel toward the first direction in the second type pixel.

In a further embodiment of the present invention, the liquid crystal panel includes a third pixel having the second layout of respective first and second sub-pixels. The first type pixel is adjacent to the third pixel with a shared data line, and the first type pixel is adjacent to the second type pixel with a shared gate line.

In another embodiment of the present invention, the liquid crystal panel includes a fourth pixel having the first layout of respective first and second sub-pixels. The fourth pixel is disposed diagonally adjacent to the first type pixel.

In a further embodiment of the present invention, the liquid crystal panel includes a plurality of gate lines, a plurality of data line pairs, and a plurality of pixels. Each data line pair includes a first data line and a second data line, and the plurality of pixels is formed at intersections of the gate lines and the data line pairs. The plurality of pixels includes the first and second type pixels, and the plurality of pixels has the first and second layouts alternating along a gate line direction and along a data line direction.

In another embodiment of the present invention, the first data line of a data line pair is coupled to one of the respective first sub-pixels and the respective second sub-pixels for a column of pixels. The second data line of the data line pair is coupled to the other of the respective first sub-pixels and the respective second sub-pixels for the column of pixels.

In another example embodiment of the present invention, a respective first data line of an N-th data line pair is coupled to the respective first sub-pixels for an N-th column of pixels and has a first polarity voltage applied thereon. A respective second data line of the N-th data line pair is coupled to the respective second sub-pixels for the N-th column of pixels and has a second polarity voltage applied thereon. A respective first data line of an (N+1)-th data line pair is coupled to the respective first sub-pixels for an (N+1)-th column of pixels and has the second polarity voltage applied thereon. A respective second data line of the (N+1)-th data line pair is coupled to the respective second sub-pixels for the (N+1)-th column of pixels and has the first polarity voltage applied thereon.

In another aspect of the present invention, a liquid crystal display device includes a liquid crystal panel having a plurality of gate lines, a plurality of data line pairs, and a plurality of pixels formed at intersections of the gate lines and the data line pairs. In addition, the liquid crystal display device includes a gate driver, a data driver, and a timing controller. The gate driver generates scan signals applied on the gate lines. The data driver generates data signals applied on the data line pairs. The timing controller controls timing of the scan signals and the data signals. The pixels have a first layout of respective first and second sub-pixels alternating with a second layout of respective first and second sub-pixels, with the first layout being different from the second layout.

In an example embodiment of the liquid crystal display device of the present invention, the pixels have the first layout alternating with the second layout along at least one of a gate line direction and a data line direction. Alternatively, the pixels have the first layout alternating with the second layout along both the gate line direction and the data line direction. In another embodiment of the present invention, the first layout is rotated 180° from the second layout.

In this manner, the liquid crystal panel of the present invention is driven according to dot inversion with alternating first and second sub-pixels determining the image displayed on the liquid crystal panel. Thus, vertical faults are prevented on the liquid crystal panel according to the present invention.

BRIEF DESCRIPTION OF THE DRAWINGS

The above and other features and advantages of the present invention will become more apparent when described in detailed exemplary embodiments thereof with reference to the attached drawings in which:

FIG. 2 illustrates polarities of data signals generated from a data driver when the liquid crystal panel of FIG. 1 is driven with column inversion, according to the conventional art;

FIG. 8 illustrates voltage polarities of data signals generated from the data driver of FIG. 6 when the liquid crystal panel of FIG. 7 is driven with column inversion, according to an embodiment of the present invention;

FIG. 12 illustrates voltage polarities of data signals generated from the data driver of FIG. 6 when the liquid crystal panel of FIG. 11 is driven with column inversion, according to another embodiment of the present invention;

The figures referred to herein are drawn for clarity of illustration and are not necessarily drawn to scale. Elements having the same reference number in FIGS. 1, 2, 3, 4, 5, 6, 7, 8, 9, 10, 11, 12, 13, and 14 refer to elements having similar structure and/or function.

DETAILED DESCRIPTION OF THE INVENTION

Figure 1:
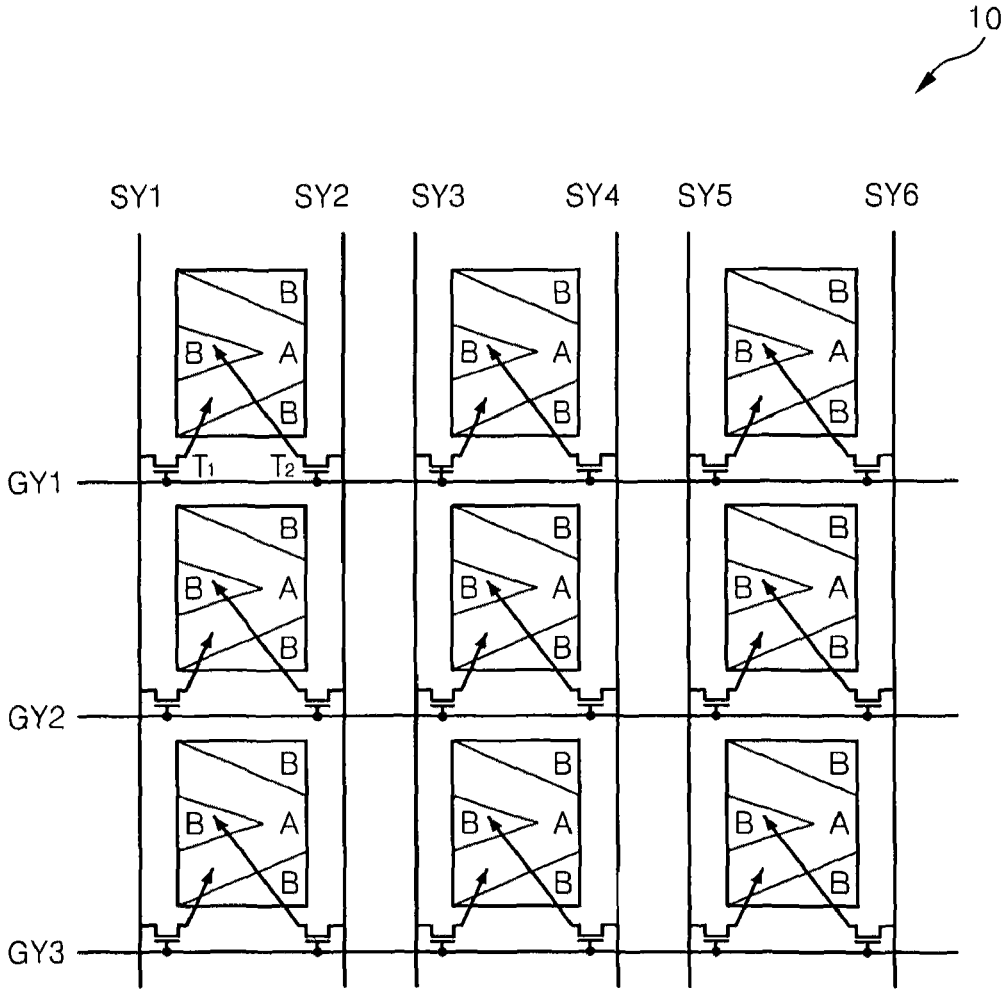
FIG. 1 (CONVENTIONAL ART)
FIG. 1 illustrates a layout of sub-pixels in a conventional liquid crystal panel having super patterned vertical alignment (S-PVA), according to the conventional art.
Figure 3:
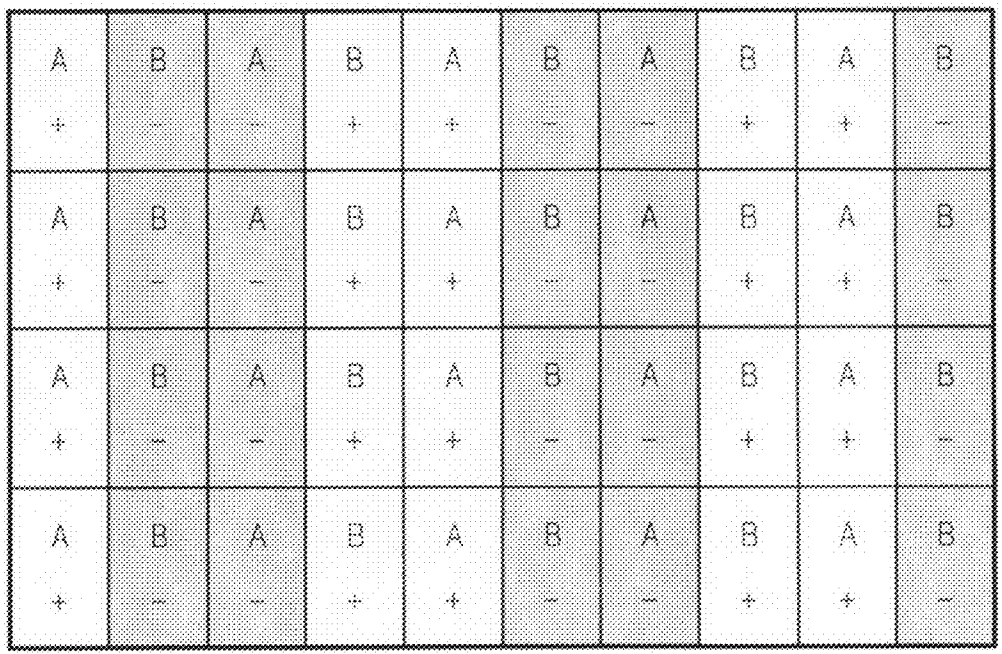
FIG. 3 (CONVENTIONAL ART)
FIG. 3 illustrates the dominant sub-pixels generating luminances according to biases with respective voltage polarities on the liquid crystal panel of FIG. 1, according to the conventional art.
Figure 4:
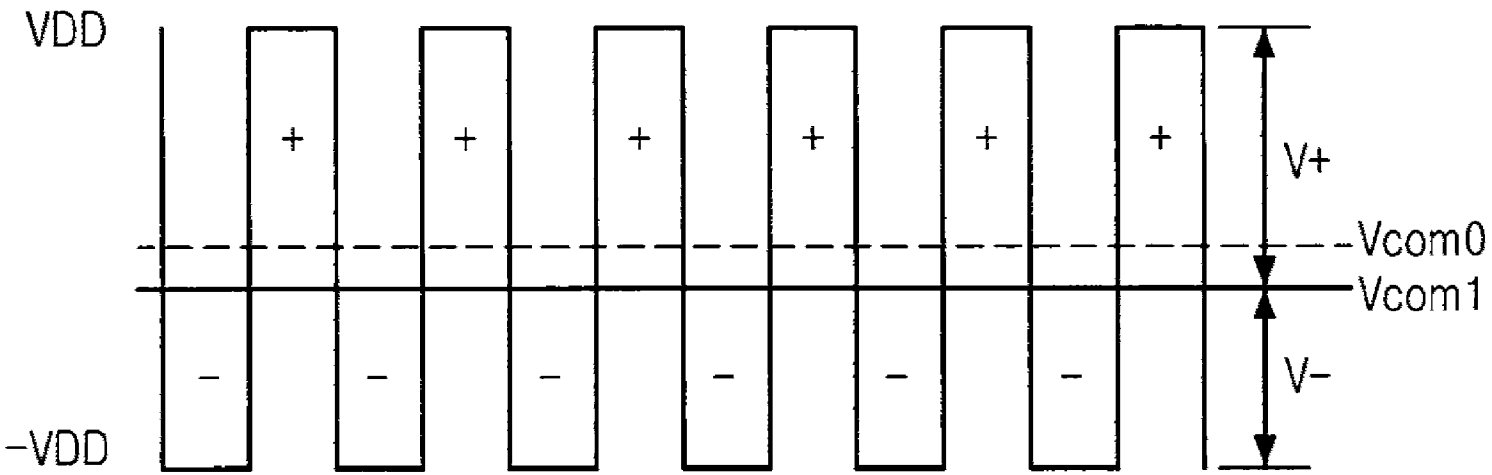
FIG. 4 (CONVENTIONAL ART)
FIG. 4 illustrates a shift of a common voltage resulting in common voltage asymmetry, according to the conventional art.
Figure 5:
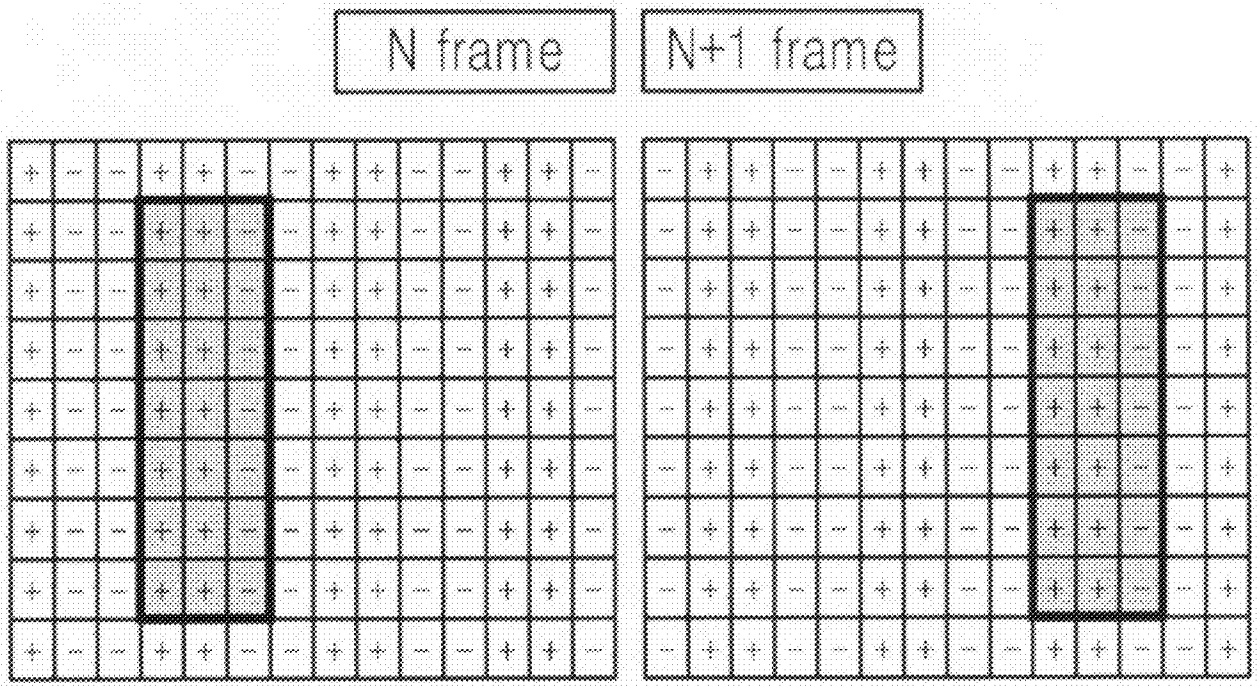
FIG. 5 (CONVENTIONAL ART)
FIG. 5 illustrates luminances generated according to biases with respective voltage polarities on the liquid crystal panel of FIG. 1 resulting in vertical fault, according to the conventional art.

The present invention is now described with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein, the term "and/or" includes any and all combinations of one or more of the associated listed items and may be abbreviated as "/".

It will be understood that, although the terms first, second, etc. may be used herein to describe various elements, these elements should not be limited by these terms. These terms are only used to distinguish one element from another. For example, a first signal could be termed a second signal, and, similarly, a second signal could be termed a first signal without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

Figure 6:
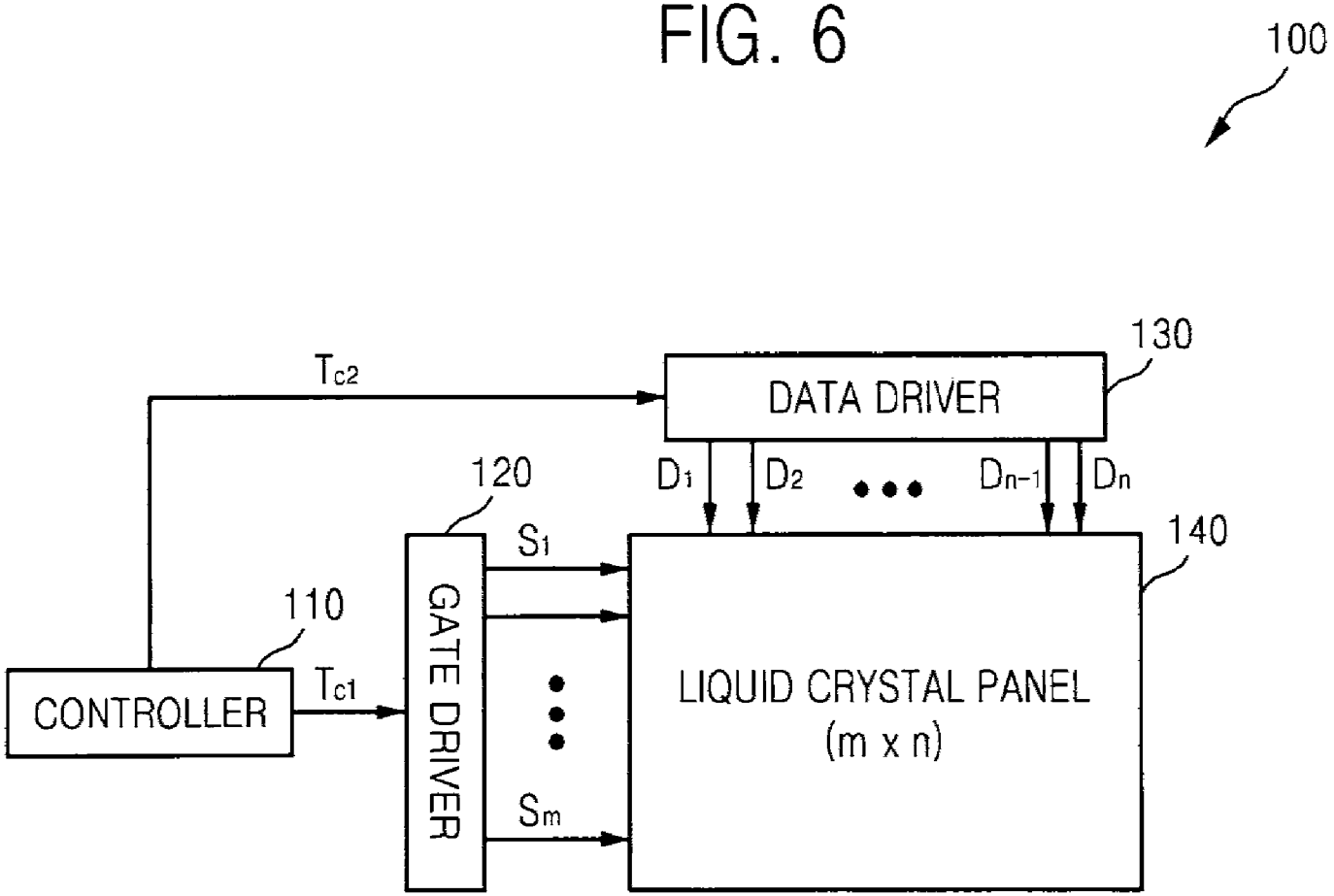
FIG. 6 shows a block diagram of a liquid crystal display device, according to an embodiment of the present invention.

FIG. 6 is a block diagram of a liquid crystal display device 100 according to an embodiment of the present invention. Referring to FIG. 6, the liquid crystal display device 100 includes a timing controller 110, a gate driver 120, a data driver 130, and a liquid crystal panel 140. The liquid crystal panel 140 includes a plurality of gate lines (not shown), a plurality of data lines (not shown), and a plurality of pixels.

The timing controller 110 generates timing control signals Tc1 and Tc2 to the gate driver 120 and the data driver 130, respectively, for controlling timing of the display device 100. The gate driver 120 generates respective scan signals S1, S2, . . . , and Sm applied on the gate lines of the liquid crystal panel 140 in response to the first timing control signal Tc1. The data driver 130 generates respective data signals D1, D2, . . . , and Dn applied on the data lines of the liquid crystal panel 140 in response to the second timing control signal Tc2.

At least one of the timing controller 110, the gate driver 120, and the data driver 130 is implemented as a single chip, in an example embodiment of the present invention. The liquid crystal panel 140 drives each of the pixels to a respective one grayscale among a plurality of grayscales based on the scan signals and the data signals.

Figure 7:
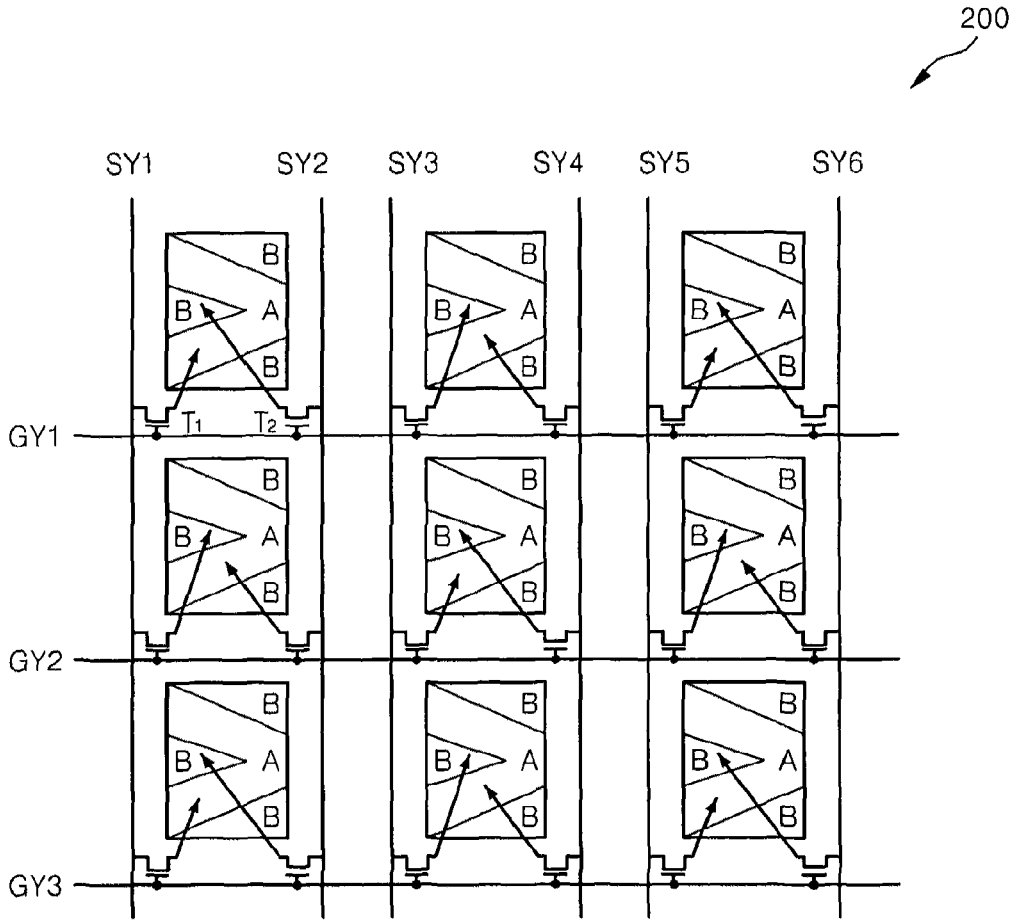
FIG. 7 illustrates a liquid crystal panel with super patterned vertical alignment (S-PVA), according to an embodiment of the present invention.

FIG. 7 illustrates a super patterned vertical alignment (S-PVA) liquid crystal panel 200 for reducing a luminance difference between column lines, according to an example embodiment of the present invention. Referring to FIG. 7, the S-PVA liquid crystal panel 200 includes a plurality of gate lines GY1, GY2, and GY3, a plurality of data lines SY1, SY2, SY3, SY4, SY5, and SY6, and a plurality of pixels each including a respective first sub-pixel A and a respective second sub-pixel B. The data lines SY1, SY2, SY3, SY4, SY5, and SY6 are paired into adjacent data line pairs, e.g., SY1 and SY2, SY3 and SY4, and SY5 and SY6. Each data line pair is connected to a respective column of pixels for providing respective data signals to the sub-pixels of such a respective column of pixels.

Each pixel in the S-PVA liquid crystal panel 200 includes a respective first sub-pixel A and a respective second sub-pixel B, laid out as illustrated in FIG. 7. In each pixel of FIG. 7, the first sub-pixel A has a first area that is larger than a second area of the second sub-pixel B toward a left side of each pixel. Also referring to FIG. 7, the second area of the second sub-pixel B is larger than the first area of the first sub-pixel A toward a right side of each pixel. In FIG. 7, the lay-out of the first and second sub-pixels A and B is the same with same orientation of the areas for the first and second sub-pixels A and B for all of the pixels including adjacent pixels of the S-PVA liquid crystal panel 200.

In the S-PVA liquid crystal panel 200 of FIG. 7, each pixel includes a respective first switching element T1 and a respective second switching element T2. Each of the first and second switching elements T1 and T2 is implemented as a MOSFET (metal oxide semiconductor field effect transistor) having a gate connected to a respective gate line GY1, GY2, or GY3, a first drain/source connected to a respective data line SY1, SY2, SY3, SY4, SY5, or SY6, and a second drain/source connected to one of the first and second sub-pixels A and B of a respective pixel.

The respective first switching elements T1 along a corresponding column of pixels provides a respective one of the odd data signals SY1, SY3, and SY5 to the corresponding column of pixels. The respective second switching elements T2 along a corresponding column of pixels provides a respective one of the even data signals SY2, SY4, and SY6 to the corresponding column of pixels. The respective first and second switching elements T1 and T2 along a row of pixels is connected to a respective one of the gate lines GY1, GY2, and GY3.

Each pair of the first and second switching elements T1 and T2 applies data signals from a corresponding data line pair to respective first and second sub-pixels A and B of a respective pixel. In addition, the respective first switching elements T1 along a row or column of pixels provides corresponding data signal(s) alternately to the first and second sub-pixels A and B along such a row or column, as illustrated in FIG. 7. Similarly, the respective second switching elements T2 along a row or column of pixels provides corresponding data signal(s) alternately to the first and second sub-pixels A and B along such a row or column, as illustrated in FIG. 7.

For example, the first switching elements T1 for the first column of pixels provide the data signal SY1 to the first sub-pixel A in the first row, the second sub-pixel B in the second row, and the first sub-pixel A in the third row, and so on. Similarly, the second switching elements T2 for the first column of pixels provide the data signal SY2 to the second sub-pixel B in the first row, the first sub-pixel A in the second row, and the second sub-pixel B in the third row, and so on.

Also, the first switching elements T1 for the first row of pixels provide the data signal SY1 to the first sub-pixel A in the first column, the data signal SY3 to the second sub-pixel B in the second column, and the data signal SY5 to the first sub-pixel A in the third column, and so on. Similarly, the second switching elements T2 for the first row of pixels provide the data signal SY2 to the second sub-pixel B in the first column, the data signal SY4 to the first sub-pixel A in the second column, and the data signal SY6 to the second sub-pixel B in the third column, and so on.

Such interlacing connection is repeated for the other rows of pixels and the other columns of pixels. Thus, the liquid crystal panel 200 of FIG. 7 has a same connection with switching elements T1 and T2 in units of two-pixels in the column and row directions of the liquid crystal panel 200. However, adjacent pixels in the column and row directions have different connections with switching elements T1 and T2 of the liquid crystal panel 200.

Figure 9:
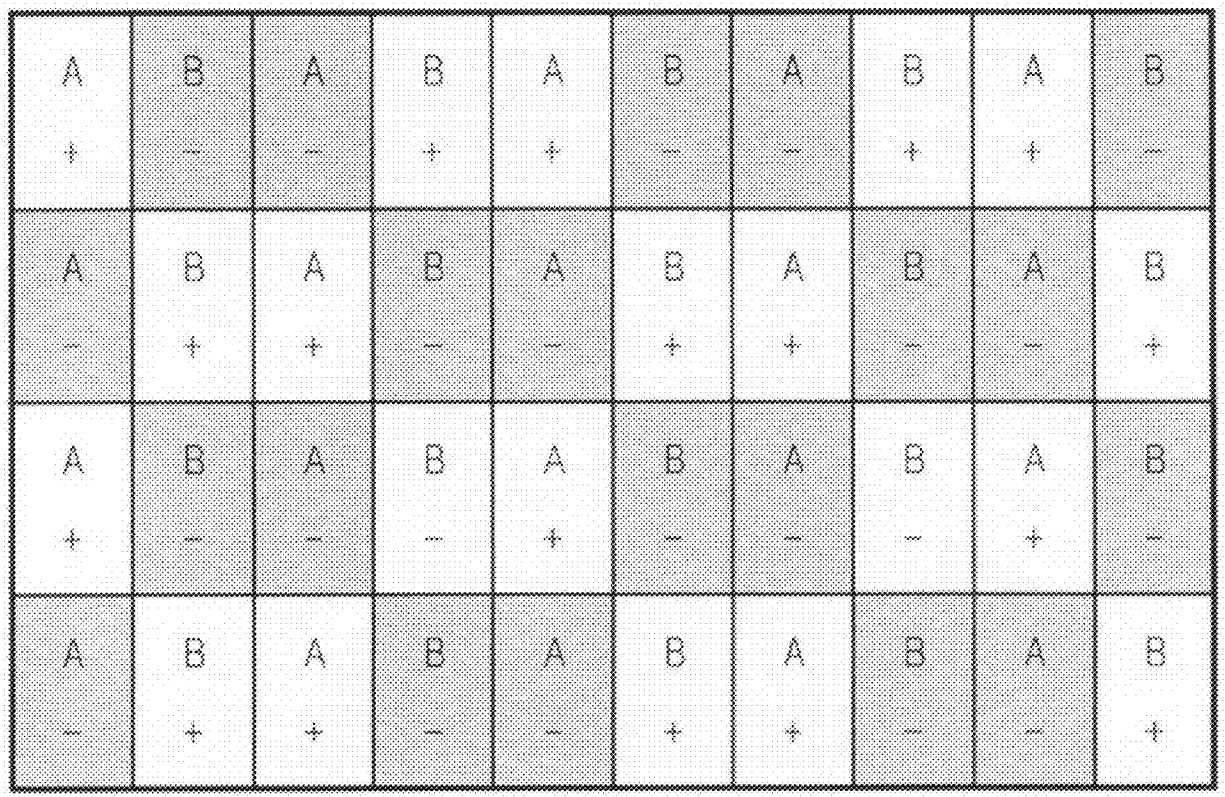
FIG. 9 illustrates dominant sub-pixels generating luminance according to voltage polarities of FIG. 8 and displayed on the liquid crystal panel of FIG. 7, according to an embodiment of the present invention.

FIG. 8 shows voltage polarities of data signals generated from a data driver when the liquid crystal panel 200 of FIG. 7 is driven with column inversion. FIG. 9 illustrates the sub-pixels dominating luminance on the liquid crystal panel 200 of FIG. 7 according to the data signals of FIG. 8.

Referring to FIGS. 7, 8, and 9, the odd data lines SY1, SY3, and SY5 have a data signal with positive polarity voltage generated thereon, and the even data lines SY2, SY4, and SY6 have a data signal with negative polarity voltage generated thereon. Thus, each data line pair has first and second data lines with data signals of positive and negative polarities generated thereon.

Further referring to FIGS. 7, 8, and 9, the respective first sub-pixels A dominate luminance toward the left direction of the first column of pixels but with alternating bias of positive and negative voltage polarities. In addition, the respective second sub-pixels B dominate luminance toward the right direction of the first column of pixels but with alternating bias of positive and negative voltage polarities. In FIG. 9, each adjacent pair of A and B sub-pixels that dominate luminance is illustrated for each pixel of FIG. 7.

Thus in FIG. 9, each rectangle represents a respective one of the sub-pixels A and B that dominates luminance from having larger area toward each of the left and right sides of a pixel. Thus, two horizontally adjacent rectangles in FIG. 9 represent respective first and second sub-pixels A and B dominating luminance toward the left and right sides of one pixel in FIG. 7.

However due to the interlacing connection of the first and second switching elements T1 and T2 in the liquid crystal panel 200, 2-dot inversion results in FIG. 9 in which voltage polarities are different every two sub-pixels. In other words, the data driver generates data signals with column inversion, but the liquid crystal panel 200 of FIG. 9 shows the effect of 2-dot inversion.

Accordingly, when the liquid crystal panel 200 is divided into a plurality of pixel blocks, each pixel block includes pixels having both of the positive and negative polarities. As a result, even with common voltage asymmetry, luminance difference may be compensated for. However, with driving the S-PVA liquid crystal panel 200 according to FIG. 8, the first sub-pixel A and the second sub-pixel B in each pixel are driven at different voltages.

Figure 10:
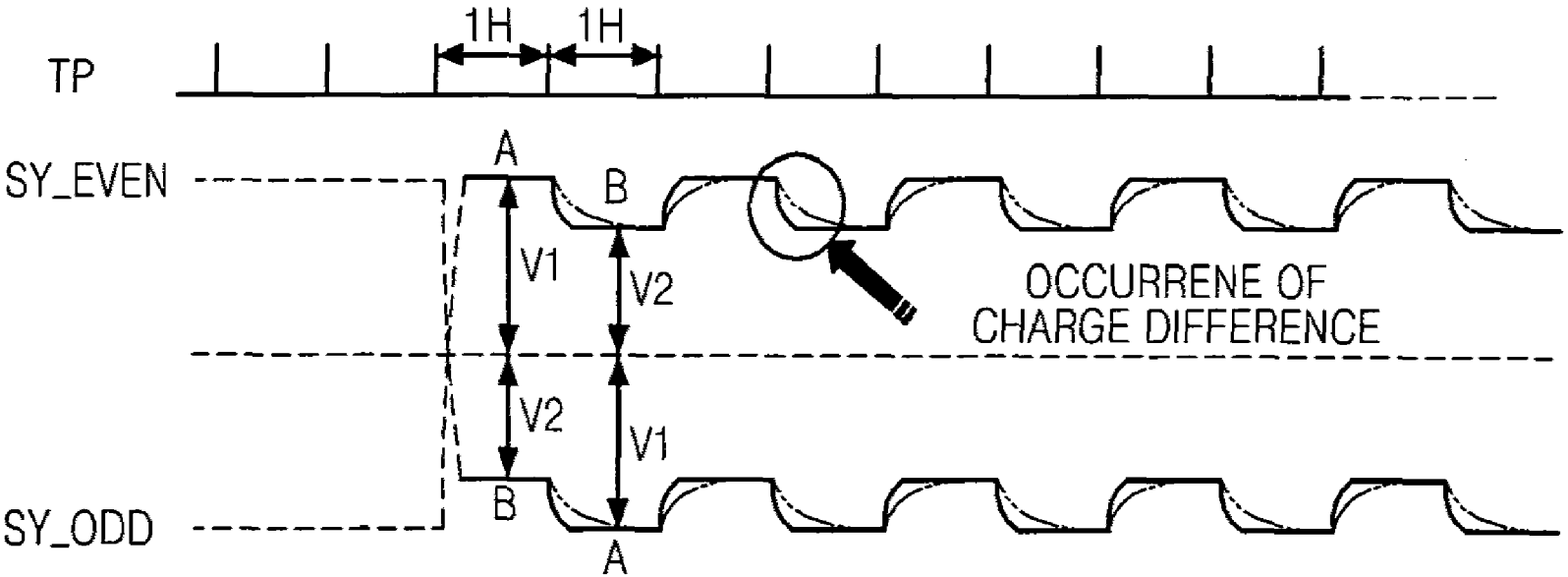
FIG. 10 is a timing diagram of data signals generated from the data driver of FIG. 6 when the liquid crystal panel of FIG. 7 is driven according to the column inversion polarities of FIG. 8, according to an embodiment of the present invention.

FIG. 10 shows a timing diagram of the data signals generated by the data driver of the liquid crystal panel 200 of FIG. 7 according to column inversion. Referring to FIG. 10, the even data lines SY_EVEN have a voltage of negative polarity generated thereon, and the odd data lines SY_ODD have a voltage of positive polarity generated thereon. Each of the data lines SY_EVEN and SY_ODD are alternately applied to a first sub-pixel A and a second sub-pixel B with time down each column of pixels.

Because of connection to different sub-pixels, a first voltage magnitude V1 is provided to the first sub-pixel A during a first gate scan period 1H, and a second voltage magnitude V2 is provided to the second sub-pixel B during a second gate scan period 1H. Each of the data lines SY1, SY2, SY3, SY4, SY5, or SY6 is alternately connect to the first sub-pixel A and the second sub-pixel B such that the corresponding data signal swings between the first voltage V1 and the second voltage V2. With higher resolution and frame rate, the gate scan period 1H is shortened such that a charge difference between adjacent pixels is induced from slew rate deviation of the data driver. As a result, a charge difference between adjacent pixels may result in vertical faults on the liquid crystal panel 200.

Figure 11:
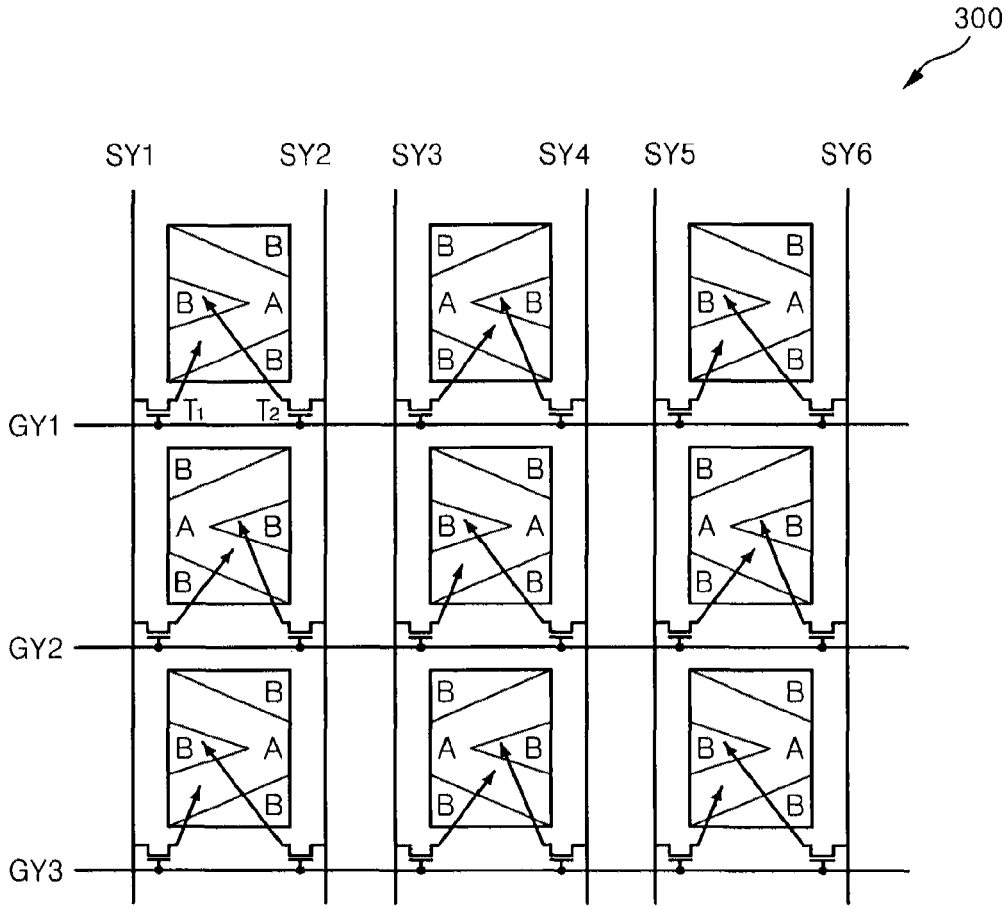
FIG. 11 illustrates layout of sub-pixels of a liquid crystal panel with super patterned vertical alignment (S-PVA), for reducing a luminance difference between column lines, according to another embodiment of the present invention.

FIG. 11 shows a liquid crystal panel 300 according to another embodiment of the present invention. The liquid crystal panel 300 may be used as the liquid crystal panel 140 of FIG. 6 according to an embodiment of the present invention.

Referring to FIGS. 6 and 11, the liquid crystal panel 300 includes a plurality of gate lines GY1, GY2, and GY3, a plurality of data lines SY1, SY2, SY3, SY4, SY5, and SY6, and a plurality of pixels having different lay-outs of sub-pixels. Each pixel includes a respective first sub-pixel A and a respective second sub-pixel B. FIG. 11 illustrates a super patterned vertical alignment (S-PVA) liquid crystal panel 300 for reducing a luminance difference between column lines, according to an example embodiment of the present invention.

In FIG. 11, the data lines SY1, SY2, SY3, SY4, SY5, and SY6 are paired into adjacent data line pairs, e.g., SY1 and SY2, SY3 and SY4, and SY5 and SY6. Each data line pair is connected to a respective column of pixels for providing respective data signals from the data driver 130 to the sub-pixels of such a respective column of pixels.

Each pixel in the S-PVA liquid crystal panel 300 includes a respective first sub-pixel A and a respective second sub-pixel B, laid out as illustrated in FIG. 11. Referring to FIG. 11, a first type of pixel has a first lay-out with a respective first sub-pixel A having a first area that is larger than a second area of a respective second sub-pixel B toward a left side (i.e., toward the west direction in FIG. 11) of such a first type of pixel.

Also in such a first type of pixel, the second area of the second sub-pixel B is larger than the first area of the first sub-pixel A toward a right side (i.e., toward the east direction in FIG. 11) of such a first type of pixel. For example, the pixel connected to the gate line GY1 and the data lines SY1 and SY2 is such a first type of pixel with the first lay-out of the first and second sub-pixels A and B.

Further referring to FIG. 11, a second type of pixel has a second lay-out with a respective first sub-pixel A having a first area that is larger than a second area of a respective second sub-pixel B toward a right side (i.e., toward the east direction in FIG. 11) of such a second type of pixel. Also in such a second type of pixel, the second area of the second sub-pixel B is larger than the first area of the first sub-pixel A toward a left side (i.e., toward the west direction in FIG. 11) of such a second type of pixel. For example, the pixel connected to the gate line GY2 and the data lines SY1 and SY2 is such a second type of pixel with the second lay-out of the first and second sub-pixels A and B.

In an example embodiment of the present invention the first lay-out of the first and second sub-pixels A and B for pixels of the first type is rotated by 180° from the second lay-out of the first and second sub-pixels A and B for pixels of the second type. In addition, pixels that are disposed diagonally adjacent to each-other have a same lay-out. For example, the pixel connected to the gate line GY1 and the data lines SY1 and SY2 has the same first lay-out as the diagonally adjacent pixel connected to the gate line GY2 and the data lines SY3 and SY4. Similarly, the pixel connected to the gate line GY1 and the data lines SY3 and SY4 has the same second lay-out as the diagonally adjacent pixel connected to the gate line GY2 and the data lines SY1 and SY2.

Further referring to FIG. 11, the liquid crystal panel 300 has pixels of the first type having the first lay-out of the sub-pixels A and B alternating with pixels of the second type having the second lay-out of the sub-pixels A and B along the row of pixels (i.e., along the gate line direction). In addition in FIG. 11, the liquid crystal panel 300 has pixels of the first type having the first lay-out of the sub-pixels A and B alternating with pixels of the second type having the second lay-out of the sub-pixels A and B along the column of pixels (i.e., along the data line direction).

Also in FIG. 11, each data line pair (SY1 and SY2, SY3 and SY4, or SY5 and SY6) is connected to a respective column of pixels. Furthermore, each gate line GY1, GY2, and GY3 is connected to a respective row of pixels. Additionally in FIG. 11, each pixel includes a respective first switching element T1 and a respective second switching element T2 to provide data signals received from a corresponding data line pair (SY1 and SY2, SY3 and SY4, or SY5 and SY6) to the respective sub-pixels A and B of the pixel.

Referring to FIG. 11, the respective first switching elements T1 along each column of pixels provide a respective data signal from a corresponding odd data line SY_ODD to the first sub-pixels A along the column of pixels. In addition in FIG. 11, the respective second switching elements T2 along each column of pixels provide a respective data signal from a corresponding even data line SY_EVEN to the second sub-pixels B along the column of pixels.

Figure 13:
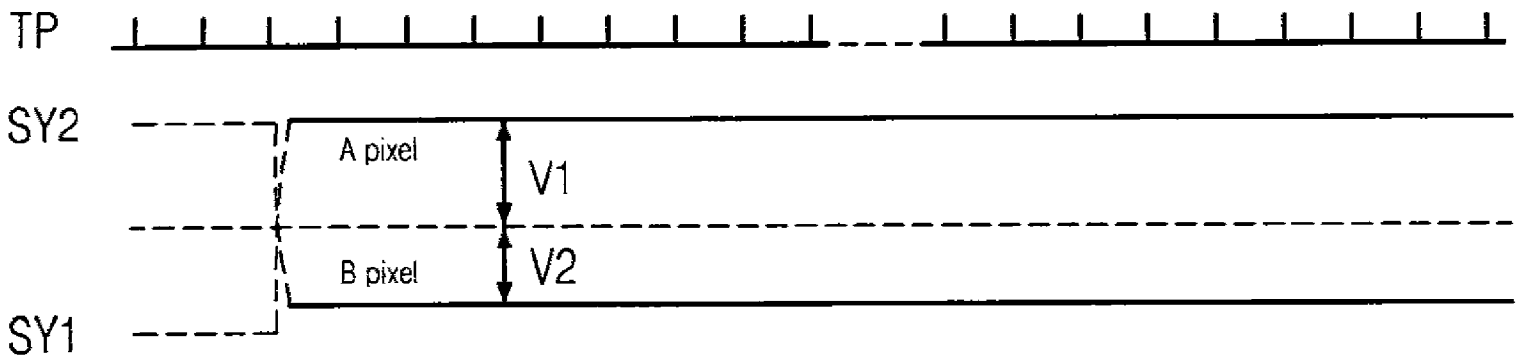
FIG. 13 is a timing diagram of data signals generated from the data driver of FIG. 6 during a one-frame period when the liquid crystal panel of FIG. 11 is driven according to the column inversion polarities of FIG. 12, according to another embodiment of the present invention.

FIG. 12 illustrates voltage polarities of data signals generated from the data driver 130 of FIG. 6 to be applied on the data lines SY1, SY2, SY3, SY4, SY5, and SY6 when the liquid crystal panel 300 of FIG. 11 is driven with column inversion, according an embodiment of the present invention. FIG. 13 is a timing diagram of the data signals generated by the data driver 130 to be applied on an example odd data line SY1 and an example even data line SY2 having positive and negative voltage polarities, respectively, during a one-frame period when the liquid crystal panel 300 of FIG. 11 is driven for column inversion according to FIG. 12.

Referring to FIGS. 11, 12, and 13, note that the respective data signal on each of the data lines SY1, SY2, SY3, SY4, SY5, and SY6 is applied to a respective one of the first sub-pixels A or the second sub-pixels B along a column of pixels. Thus in FIG. 13, the respective data signal on each of the data lines SY1, SY2, SY3, SY4, SY5, and SY6 does not vary between multiple voltage magnitudes V1 and V2 such that differences in charge accumulation is prevented between pixels, in contrast to FIG. 10.

In addition, respective data lines of a data line pair (SY1 and SY2, SY3 and SY4, or SY5 and SY6) have data signals of opposite voltage polarity. Furthermore, respective first data lines disposed to the left in an N-th data line pair and an (N+1)-th data line pair have opposite voltage polarities. Similarly, respective second data lines disposed to the right in the N-th data line pair and the (N+1)-th data line pair have opposite voltage polarities.

For example, the first data line SY1 of the first data line pair SY1 and SY2 has positive voltage polarity, while the first data line SY3 of the second data line pair SY3 and SY4 has negative voltage polarity. Similarly, the second data line SY2 of the first data line pair SY1 and SY2 has negative voltage polarity, while the second data line SY4 of the second data line pair SY3 and SY4 has positive voltage polarity.

Figure 14:
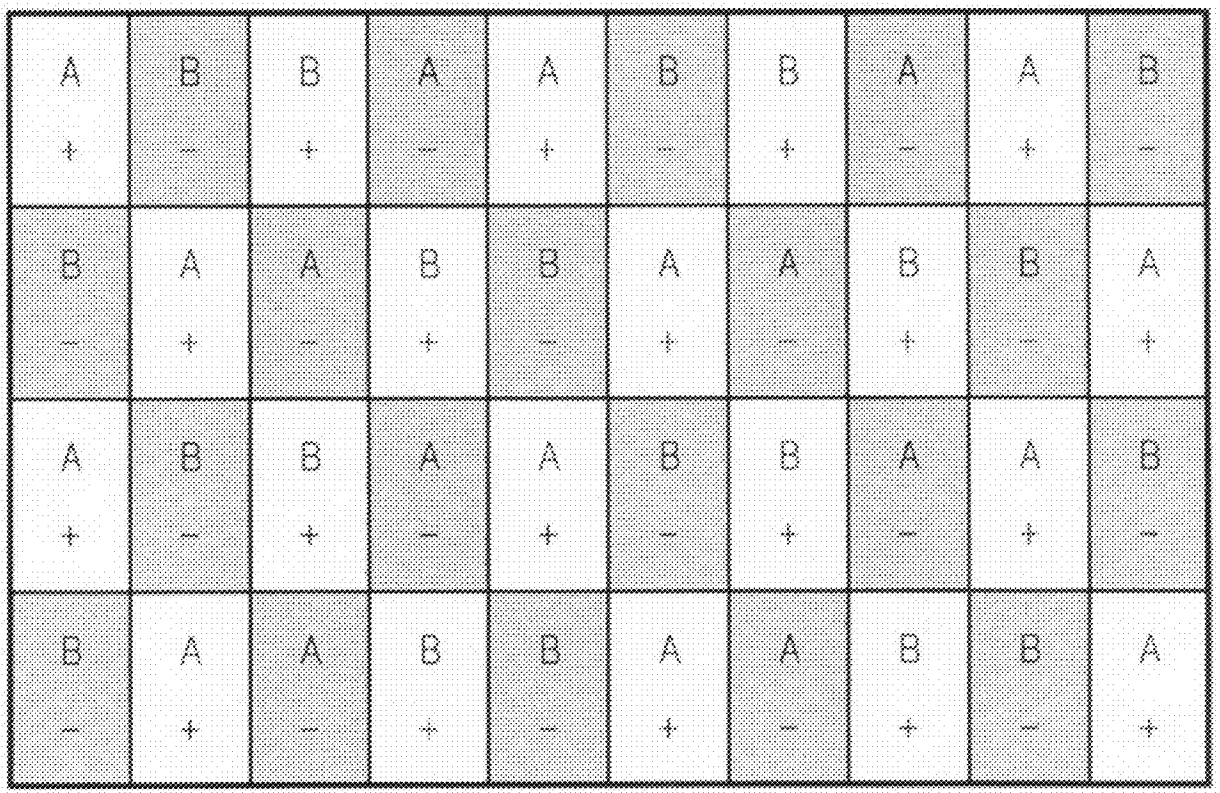
FIG. 14 illustrates dominant sub-pixels generating luminance according to voltage polarities of FIG. 12 and displayed on the liquid crystal panel of FIG. 11, according to another embodiment of the present invention.

FIG. 14 illustrates the dominant sub-pixel having luminance on the liquid crystal panel 300 of FIG. 11 according to the data signals of FIG. 12. In FIG. 14, each rectangle represents a respective one of the sub-pixels A and B that dominates luminance from having larger area toward each of the left and right sides of a pixel. Thus, two horizontally adjacent rectangles in FIG. 14 represent respective first and second sub-pixels A and B dominating luminance toward the left and right sides of one pixel in FIG. 11.

For example referring to FIGS. 11, 12, and 14, the respective first sub-pixels A having a data signal of positive voltage polarity applied thereon and the respective second sub-pixels B having a data signal of negative voltage polarity applied thereon alternate down toward the left and right sides of the first column of pixels. Similarly, the respective first sub-pixels A having a data signal of negative voltage polarity applied thereon and the respective second sub-pixels B having a data signal of positive voltage polarity applied thereon alternate down toward the left and right sides of the second column of pixels.

As a result, even though the data driver 130 generates data signals according to column inversion, adjacent sub-pixels on the liquid crystal panel 300 are driven with different voltage polarities, as illustrated in FIG. 14. In other words, the liquid crystal panel 300 is driven according to dot inversion.

Accordingly, a luminance difference between adjacent pixels from common voltage asymmetry is compensated to prevent vertical faults. In addition, even with a slew rate deviation between adjacent pixels, the voltage provided to the first sub-pixels A and the second sub-pixels B does not swing between multiple voltages (such as V1 and V2 of FIG. 10 for example) such that a charge difference between the pixels occurs only during the first gate scan period 1H while a frame is changed.

Accordingly, as compared to the liquid crystal panel 200 of FIG. 7, a luminance difference induced by a data signal of a data line changing between multiple voltages is prevented such that vertical faults are not displayed on the liquid crystal panel 300 of FIG. 11. Such vertical faults may be prevented even for the liquid crystal panel 300 having high-resolution and high-frame rate operation.

While the present invention has been shown and described with reference to exemplary embodiments thereof, it will be understood by those of ordinary skill in the art that various changes in form and detail may be made herein without departing from the spirit and scope of the present invention, as defined by the following claims.

The present invention is limited only as defined in the following claims and equivalents thereof.

What is claimed is:

1. A liquid crystal panel comprising:

a first pixel having a first layout of respective first and second sub-pixels;

a second pixel having a second layout of respective first and second sub-pixels; and a third pixel having the second layout of respective first and second sub-pixels;

wherein the first layout is different from the second layout, and wherein the first layout is rotated 180° from the second layout within a plane of the first and second layouts of the liquid crystal panel, and wherein the first and second pixels having the first and second layouts that are rotated 180° from each other are disposed along a row direction, and wherein the first and third pixels having the first and second layouts that are rotated 180° from each other are disposed along a column direction.

2. The liquid crystal panel of 1, wherein the first pixel is adjacent to the second pixel with a shared gate line.

3. The liquid crystal panel of 1, wherein the first pixel is adjacent to the third pixel with a shared data line.

4. The liquid crystal panel of 1, wherein the first pixel is adjacent to the third pixel with a shared data line pair.

5. The liquid crystal panel of claim 1, wherein the first pixel includes a respective first area of the respective first sub-pixel that is larger than a respective second area of the respective second sub-pixel toward a first direction in the first pixel;

and wherein the respective second area of the respective second sub-pixel is larger than the respective first area of the respective first sub-pixel toward a second direction in the first pixel;

and wherein the second pixel includes a respective first area of the respective first sub-pixel that is larger than a respective second area of the respective second sub-pixel toward the second direction in the second pixel;

and wherein the respective second area of the respective second sub-pixel is larger than the respective first area of the respective first sub-pixel toward the first direction in the second pixel.

6. The liquid crystal panel of claim 1, wherein the first pixel is adjacent to the third pixel with a shared data line, and wherein the first pixel is adjacent to the second pixel with a shared gate line.

7. The liquid crystal panel of claim 6, further comprising:

a fourth pixel having the first layout of respective first and second sub-pixels;

wherein the fourth pixel is disposed diagonally adjacent to the first pixel and wherein diagonally adjacent pixels have a same one of the first and second layouts.

8. The liquid crystal panel of claim 1, further comprising:

a plurality of gate lines;

a plurality of data line pairs, each pair including a first data line and a second data line; and a plurality of pixels formed at intersections of the gate lines and the data line pairs;

wherein the plurality of pixels includes the first and second pixels, and wherein the plurality of pixels has the first and second layouts alternating along a gate line direction and along a data line direction.

9. The liquid crystal panel of claim 8, wherein the first data line of a data line pair is coupled to one of the first sub-pixels and the second sub-pixels for a column of pixels, and wherein the second data line of said data line pair is coupled to the other of the first sub-pixels and the second sub-pixels for said column of pixels.

10. The liquid crystal panel of claim 9, wherein a respective first data line of an N-th data line pair is coupled to the first sub-pixels for an N-th column of pixels and has a first polarity voltage applied thereon, and wherein a respective second data line of the N-th data line pair is coupled to the second sub-pixels for the N-th column of pixels and has a second polarity voltage applied thereon, and wherein a respective first data line of an (N+1)-th data line pair is coupled to the first sub-pixels for an (N+1)-th column of pixels and has the second polarity voltage applied thereon, and wherein a respective second data line of the (N+1)-th data line pair is coupled to the second sub-pixels for the (N+1)-th column of pixels and has the first polarity voltage applied thereon.

11. A liquid crystal display device comprising:

a liquid crystal panel including a plurality of gate lines, a plurality of data line pairs, and a plurality of pixels formed at intersections of the gate lines and the data line pairs;

a gate driver for generating scan signals applied on the gate lines;

a data driver for generating data signals applied on the data line pairs; and a timing controller for controlling timing of the scan signals and the data signals, wherein the pixels have a first layout of respective first and second sub-pixels alternating with a second layout of respective first and second sub-pixels, with the first layout being different from the second layout, and wherein the first layout is rotated 180° from the second layout within a plane of the first and second layouts of the liquid crystal panel and wherein a first set of the pixels having the first and second layouts that are rotated 180° from each other are disposed along a row direction, and wherein a second set of the pixels having the first and second layouts that are rotated 180° from each other are disposed along a column direction.

12. The liquid crystal display device of claim 11, wherein the pixels have the first layout alternating with the second layout along at least one of a gate line direction and a data line direction.

13. The liquid crystal display device of claim 11, wherein the pixels have the first layout alternating with the second layout along both a gate line direction and a data line direction.

14. The liquid crystal display device of claim 11, wherein a first pixel includes a respective first area of the respective first sub-pixel that is larger than a respective second area of the respective second sub-pixel toward a first direction in the first pixel;

and wherein the respective second area of the respective second sub-pixel is larger than the respective first area of the respective first sub-pixel toward a second direction in the first pixel;

and wherein a second pixel includes a respective first area of the respective first sub-pixel that is larger than a respective second area of the respective second sub-pixel toward the second direction in the second pixel that is adjacent to the first pixel;

and wherein the respective second area of the respective second sub-pixel is larger than the respective first area of the respective first sub-pixel toward the first direction in the second pixel.

15. The liquid crystal display device of claim 11, wherein pixels disposed diagonally adjacent to each-other have a same one of the first and second layouts.

16. The liquid crystal display device of claim 11, wherein the first data line of a data line pair is coupled to one of the first sub-pixels and the second sub-pixels. for a column of pixels, and wherein the second data line of said data line pair is coupled to the other of the first sub-pixels and the second sub-pixels for said column of pixels.

17. The liquid crystal display device of claim 16, wherein a respective first data line of an N-th data line pair is coupled to the first sub-pixels for an N-th column of pixels and has a first polarity voltage applied thereon, and wherein a respective second data line of the N-th data line pair is coupled to the second sub-pixels for the N-th column of pixels and has a second polarity voltage applied thereon, and wherein a respective first data line of an (N+1)-th data line pair is coupled to the first sub-pixels for an (N+1)-th column of pixels and has the second polarity voltage applied thereon, and wherein a respective second data line of the (N+1)-th data line pair is coupled to the second sub-pixels for the (N+1)-th column of pixels and has the first polarity voltage applied thereon.

* * * * *